United States Patent [19]

Maierson

[11] Patent Number: 4,556,687

[45] Date of Patent: Dec. 3, 1985

[54] COLOR DEVELOPER FOR PRESSURE-SENSITIVE RECORDING PAPERS

[75] Inventor: Theodore Maierson, Dayton, Ohio

[73] Assignee: The Standard Register Company, Dayton, Ohio

[21] Appl. No.: 590,842

[22] Filed: Mar. 19, 1984

[51] Int. Cl.[4] ..... B41M 5/16; B41M 5/22

[52] U.S. Cl. ..... 524/333; 568/33; 524/171; 428/341; 106/21; 346/212

[58] Field of Search ..... 524/333, 171; 568/33; 428/341; 106/21; 282/27.5

[56] References Cited

U.S. PATENT DOCUMENTS

| | | | |
|---|---|---|---|
| 3,244,550 | 4/1966 | Farnham et al. | 282/27.5 |
| 3,560,229 | 2/1971 | Farnham et al. | 106/21 |
| 3,834,929 | 9/1974 | Hayashi et al. | 346/210 |
| 4,089,547 | 5/1978 | Brynko et al. | 346/225 |
| 4,168,845 | 9/1979 | Oeda et al. | 346/209 |
| 4,203,619 | 5/1980 | Sanders | 106/14.5 |
| 4,219,220 | 8/1980 | Oda et al. | 106/21 |
| 4,260,179 | 4/1981 | Yamaguchi et al. | 106/21 |
| 4,262,938 | 4/1981 | Yamaguchi et al. | 106/21 |
| 4,264,365 | 4/1981 | Sanders | 106/14.5 |
| 4,268,069 | 5/1981 | Stolfo | 106/21 |
| 4,387,117 | 6/1983 | Shanton | 427/150 |
| 4,391,850 | 7/1983 | Shanton | 427/150 |
| 4,391,852 | 7/1983 | Nakamura et al. | 427/150 |
| 4,407,892 | 10/1983 | Yamaguchi et al. | 428/411 |

*Primary Examiner*—John Kight
*Assistant Examiner*—M. L. Moore
*Attorney, Agent, or Firm*—Jacox & Meckstroth

[57] ABSTRACT

A developer system comprising a zinc chelate of 4,4'-dihydroxydiphenyl sulfone is provided for developing colorless dye precursors used in carbonless copy paper systems. The system preferably includes a styrene-methacrylic acid copolymer and a mineral matrix, especially sodium aluminosilicate, which promotes reactivity of the chelate. The developer system is particularly useful in coating compositions for carbonless second sheets.

14 Claims, No Drawings

COLOR DEVELOPER FOR PRESSURE-SENSITIVE RECORDING PAPERS

FIELD OF THE INVENTION

The present invention relates to novel color developers for use in carbonless copy papers which will produce a stable intense mark when placed in contact with colorless dye precursors, and which is not subject to yellowing. The present invention also relates to developer systems, coating compositions and record material sheets which contain such novel color developers.

BACKGROUND OF THE INVENTION

In the manufacture of pressure-sensitive recording papers, better known as carbonless copy papers, a layer of pressure-rupturable microcapsules containing a solution of colorless dyestuff precursor is normally coated on the back side of the front sheet of paper of a carbonless copy paper set. This coated backside is known as the CB coating. In order to develop an image or copy, the CB coating must be mated with a paper containing a coating of suitable color developer, also known as dyestuff acceptor, on its front. This coated front color developer coating is called the CF coating. The color developer is a material, usually acidic, capable of forming the color of the dyestuff by reaction with the dyestuff precursor. Marking of the pressure-sensitive recording papers is effected by rupturing the capsules in the CB coating by means of pressure to cause the dyestuff precursor solution to be exuded onto the front of the mated sheet below it. The colorless or slightly colored dyestuff, or dyestuff precursor, then reacts with the color developer in the areas at which pressure was applied, thereby effecting the colored marking. Such mechanism or the producing technique of pressure-sensitive recording papers is well known.

Among the well-known basic, reactive, colorless, chromogenic dye precursors conventionally used in such carbonless copy paper systems, include those belonging to the classes of the phthalides, fluoranes, spiropyranes, azomethines, triarylmethane-leuco dyes, of the substituted phenoxazines or phenothiazines, and of the chromeno or chromane color formers. Examples of such suitable color precursors are: crystal violet lactone, 3,3-(bisamino-phenyl)-phthalides, 3,3-(bisubstituted indolyl)-phthalides, 3-(aminophenyl)-3-indolylphthalides, 6-dialkylamino-2-n-octylaminofluoranes, 6-dialkylamino-2-arylaminofluoranes, 6-dialkylamino-3-methyl-2-arylaminofluoranes, 6-dialkylamino-2- or 3-lower alkylfluoranes, 6-dialkylamino-2-dibenzylaminofluoranes, 6-dialkylamino-2-dibenzylaminofluoranes, 6-diethylamino-1,3-dimethylfluoranes, the lactonexanthenes, the leucoauramines, the 2-(omega substituted vinylene)-3,3-disubstituted-3-1-1-indoles, 1,3,3-trialkylindolinospirans, bis-(aminophenyl)-furyl-, phenyl- or carbazolylmethanes, or benzoyl-leucomethylene blue.

Known color developers for use in such recording papers have included:

(1) novolac phenolic resins made by acid catalyzed condensation of phenol, resorcinol, pyrogallol, cresols, xylenols, or alkyl phenols, such as p-tertiary butyl phenol, with aldehydes such as formaldehyde, acetaldehyde, benzaldehyde and butyraldehyde;

(2) metal salts of aromatic carboxylic acids with an OH group at the ortho position, such as zinc salts of salicylic acid, 3,5-di-tert-butyl salicylic acid, octyl salicylic acid, and 1-hydroxy-2-naphthoic acid, and (3) acid-treated clays such as kaolinites and attapulgites.

One of the disadvantages of the use of traditional phenolic resins, such as novoloac-type resins, including the zinc salts of such resins and halogen-substituted resins, is the characteristic of yellowing during storage. Thus, the search has continued for other developers, particularly those having the advantages of phenolic-type resins, having high developing power, rapid developing speed, good light resistance, and time stability without yellowing. Another disadvantage of common phenolic developers is the adverse affect thereon by solvents or solvent vapors.

The compound 4,4'-sulfonyl diphenyl (hereinafter SDP) has been listed as a possible color developer in, for example, U.S. Pat. Nos. 3,244,550, and 3,560,229, all to Farnham et al. Sulfonyl diphenol is also mentioned in U.S. Pat. Nos. 4,264,365 and 4,203,619 to Sanders. Hayashi et al, U.S. Pat. No. 3,834,929 disclose metal phenolates in which the phenol compound used to form the metal phenolate may be 4,4'-dihydroxy-3,3'-dichloro (or 3,3',5,5'-tetrachloro)diphenyl sulfone. Furthermore, Yamaguchi et al, U.S. Pat. No. 4,260,179, disclose 2,2'-bisphenolsulfone zinc salts. The use of 4,4'-dihydroxy-diphenyl sulfone as a color developer in CF coating systems has not achieved commercial acceptance, however, as, while SDP will modestly react with most leuco dyestuffs if properly handled, its sensitivity is affected by deposition conditions, and it is not easily adaptable as a single-component CF reactant.

SUMMARY OF THE INVENTION

Accordingly, it is an object of the present invention to provide a novel color developer for use in carbonless copy paper systems.

It is yet another object of the present invention to provide a developer for use in carbonless copy paper systems which eliminates the deficiencies of the prior art.

It is another object of the present invention to provide an improved developer system for use in pressure-sensitive recording papers.

It is still another object of the present invention to provide improved coating compositions for use in making coated front record sheets in pressure-sensitive carbonless copy paper systems.

It is a further object of the present invention to provide an improved record sheet coated with such an improved coating composition.

It is still another object of the present invention to provide a phenolic-type color developer which does not yellow with time.

It is yet a further object of the present invention to provide a color developer for use in pressure-sensitive recording systems which is not adversely affected by solvent vapors.

These and other objects of the present invention are obtained by means of the novel color developer and developing systems of the present invention, wherein the primary color developer is the chelate with zinc of 4,4'dihydroxydiphenyl sulfone. The 4,4'-dihydroxydiphenyl sulfone (sulfonyl diphenol) portion of the chelate of the present invention is hereinafter referred to as "SDP".

The reactivity of this improved developer is even further enhanced by adsorption of the chelate onto a mineral matrix within the coating composition, particularly a synthetic sodium aluminosilicate, or onto an organic matrix comprising a copolymer of styrene and methacrylic acid, or, preferably, by adsorption onto a combination of these mineral and organic matrices. A suitable binder may also be used in order to make the CF coating composition.

DETAILED DESCRIPTION OF PREFERRED EMBODIMENTS

While SDP has been disclosed to be useful as a color developer in CF coating systems, it is highly sensitive and affected by deposition conditions. Furthermore, it is not easily adaptable as a single component CF reactant. It has unexpectedly been found that the zinc chelate of the 4,4'-SDP displays a reactivity toward dye precursors commonly used in carbonless copy paper systems which is markedly improved over that of SDP. Chelation of SDP with a zinc halide strongly enhances the imaging reactivity of SDP without adversely affecting the solubility characteristics. The zinc-SDP complex of the present invention is distinguished from the zincated phenolics of the prior art insofar as the present complex is a true chelate, rather than an addition compound, such as the zinc phenolates described in U.S. Pat. No. 3,824,929 to Hayashi et al. Furthermore, the 4,4'-dihydroxydiphenyl sulfone zinc complex is a substantially different compound than the 2,2'-dihydroxydiphenyl sulfone zinc salt of the Yamaguchi U.S. Pat. No. 4,260,179. The 4,4'-bisphenol sulfone compound cannot make a salt in the same manner as the 2,2'-compound.

The zinc chelate of the present invention is characterized as a coordination complex with SDP formed in acid solution in the absence of metallic ions other than zinc. The complex is conveniently formed by dissolution of SDP in a suitable solvent system comprising water and a water-soluble organic solvent, followed by addition of zinc halide. The zinc halide forms a chelate with SDP without forming an addition compound. The chelate balances the reactivity of SDP and remains in solution as long as it is acidic.

Any solvent system which completely dissolves SDP may be employed. Suitable water-soluble organic solvents include lower alcohols, such as methyl, ethyl, and isopropyl alcohol; diacetone; tetrahydrofurfural; lower ketones; and various glycol ethers such as Methyl-Carbitol (diethylene-glycol monomethyl ether). Glycol ethers are particularly desirable solvents, as they function to swell the styrene/methacrylic copolymer, and, during drying, some fusion of the polymer occurs to provide the coating composition with adhesive properties. The quantity of solvent to be used is preferably the minimum quantity required for complete dissolution of the SDP.

While any zinc halide may be used as chelant, zinc bromide is preferred. Zinc chloride does not promote reactivity of SDP to the extent that zinc bromide does, and zinc chloride is known to cause corrosion in paper-handling equipment.

The pH of the chelation solution must be maintained below about 7.0, preferably between 5.5 and 6, to stabilize the chelate. If alkaline agents such as sodium aluminosilicate are subsequently added to the solution, it is desirable to employ an excess of zinc bromide to prevent alkaline buffering and resultant massive flocculation. Characteristically, formation of the chelate upon addition of $ZnBr_2$ to SDP is signalled by conversion of the colorless SDP solution to a colorful pink solution. An excess of zinc also forces the chelation reaction to proceed further. To avoid diminishing the adhesive effects of the binder which may be caused by the excess of zinc, a small amount of sequestering agent, such as NaEDTA, may be added just prior to the addition of binder.

Reactivity of the chelate is enhanced by adsorption onto a mineral matrix, preferably sodium aluminosilicate; alternatively, acid clays (e.g., silton), attapulgite clays, hydrated alumina, silica, and other zeolites may be employed as the mineral matrix. Synthetic sodium aluminosilicates (e.g., HYDREX, available from J. M. Huber Co.), in particular, enhance the activity of Zn-SDP chelate, apparently by promoting some desirable precipitation within the matrix interstices.

Additional enhancement of reactivity is obtained by adsorption of chelated SDP on a styrene-methacrylic acid copolymer. Zn-SDP chelate adsorbed on the copolymer is a good imaging agent for solubilized dyestuff precursor, even without the presence of inorganic fillers. Optimum imaging, and, in fact, synergistic results are achieved, however, with Zn-SDP chelate and a combination of organic and inorganic matrices. Copolymers useful as the organic matrix comprise conventional copolymers of styrene and methacrylic acid having a methacrylic acid content of preferably no more than about 10% (w/w). The copolymer is combined with the chelate in the form of a copolymer emulsion, typically containing from about 30% to about 60% solids. Suitable emulsions are generally available in commerce; exemplary products include acidic emulsions, such as LYTRON 5450 (pH 6) (distributed by Monsanto), which do not destabilize the chelate. Preferably, the emulsions comprise fine to extremely fine particulate dispersions to minimize viscosity of the final product; particle sizes of less than 1 micron are preferred, most preferably from about 0.1 to about 0.5 micron. It is of particular interest to note that the styrene/methacrylic acid copolymers themselves exhibit no developer activity toward leuco dyestuffs; however, in conjunction with the Zn-SDP chelate, there is a substantial improvement in reactivity of the coating system. The reason for this is not understood. It is conjectured, however, that the copolymer has a strong affinity for the dyestuff solvents, and prevents excess downward migration of the solubilized dyestuff in the coating composition. In the course of the developing sequence, the copolymer generally becomes slightly swollen. However, it retains a pleasing whiteness, and provides a bright coating.

The developer system of the present invention thus essentially includes a zinc chelate of SDP, preferably the chelation product of SDP and zinc bromide, which may be the sole color developer of the developing system. The chelate is most preferably employed in combination with a styrene/methacrylic acid copolymer and a mineral component, especially sodium aluminosilicate, to improve reactivity of the system. For use in a CF coating composition, the developer system is generally combined with a conventional binder. Any binder conventionally used for this purpose, such as styrene-butadiene latex, may be used.

Conventional additives, such as colloidal alumina, colloidal silica, synthetic silica, barium sulfate, titanium dioxide, and other cosmetic materials may be included. Preferred additives in the CF coating composition of the present invention are talc, kaolin, and/or synthetic silica. In this context, both talc and kaolin function as extenders, promoting activity of the synthetic sodium aluminosilicate, and imparting a desirable "feel" to the coating. Kaolin, in a proportion of about 5 parts aluminosilicate to about 2 parts kaolin, is especially preferred.

The developer compositions in accordance with the present invention are preferably obtained by first forming the zinc-SDP chelate, then adding the carrier pigments, preferably synthetic sodium aluminosilicate, followed by other mineral additives, such as talc or kaolin, and then adding the polymer emulsion. The zinc-SDP chelate together with the sodium aluminosilicate and the styrene/methacrylic acid copolymer essentially provide the outstanding developing characteristics of the system, while the styrene-butadiene latex binder and the talc or kaolin are used for the properties of easing application of the composition to the sheets.

The operable amounts of each of the components of the present composition are easily determinable by those skilled in the art, particularly in view of the optimum amounts set forth in the following examples. Preferably, for each part of the zinc-SDP chelate used, about 1–5 parts of sodium aluminosilicate should be used, and about 1–5 parts of the styrene/methacrylic acid copolymer.

The color developer system of the present invention may be used with any of the color precursors known to the art such as those listed hereinabove in the background of the invention.

The following examples are included to illustrate the practice of the present invention.

EXAMPLE 1

A coating composition was prepared as follows:

A solvent system for solubilizing SDP was prepared by admixing 40 g of Methyl-Carbitol and 10 g of isopropyl alcohol, and then adding 100 g of water. If desired, the isopropyl alcohol can be eliminated and replaced by 10 additional grams of Methyl-Carbitol. 7.5 g of SDP is dissolved in the solvent system, followed by the addition of 6.6 g of zinc bromide in a 77% aqueous solution in order to form the soluble Zn-SDP chelate.

To the chelation solution are added 30 g of sodium aluminosilicate (HYDREX) 40 g kaolin, and 50 g of sytrene-methacrylic acid emulsion—48% solids. 7.2 g of NaEDTA (VERSENE 100) are then added, followed by 50 g of styrene butadiene latex—50% solids (DOW 620).

The mixture was stirred to develop a homogeneous coating composition.

EXAMPLE 2

The coating composition prepared according to Example 1 is applied as an aqueous system to one side of a substrate comprising a support sheet, and the composition solvent evaporated to dryness to form a CF coating. A substrate having a conventional CB coating containing microencapsulated leuco dyestuffs is juxtaposed with the CF coating, and the capsules ruptured in a pattern to transfer the dyestuff to the CF coating. An excellent image of the pattern is obtained.

While the above composition has been described for use in a pressure-sensitive copy paper system, it should be understood that the developer could be formulated for use in a heat-sensitive recording paper system, as will be understood by those skilled in the art.

It will be further obvious to those skilled in the art that various other changes may be made without departing from the scope of the invention, and the invention is not to be considered limited to what is described in the specification.

What is claimed is:

1. A color developer for colorless dye precursors comprising the chelation product of zinc bromide and 4,4'-dihydroxyldiphenyl sulfone.

2. A color developer system for colorless dye precursors, comprising a zinc chelate of 4,4'-dihydroxydiphenyl sulfone and a mineral matrix.

3. A developer system in accordance with claim 2, wherein the mineral matrix is a synthetic sodium aluminosilicate.

4. A developer system in accordance with claim 3, wherein the chelate is the chelation product of zinc bromide and 4,4'-dihydroxydiphenyl sulfone.

5. A coating composition for carbonless record sheets comprising the developer system in accordance with claim 2 and a binder.

6. A coating composition in accordance with claim 5, wherein the mineral matrix of the developer system is a synthetic sodium aluminosilicate.

7. A coating composition in accordance with claim 6, wherein the chelate is the chelation product of a zinc halide and 4,4'-dihydroxydiphenyl sulfone.

8. A coating composition in accordance with claim 7, wherein the zinc halide is zinc bromide.

9. A coating composition in accordance with claim 7, wherein the zinc halide is zinc chloride.

10. A coating composition in accordance with claim 8, wherein the binder is a styrene-butadiene latex.

11. A coating composition in accordance with claim 10, further including talc or kaolin.

12. A coating composition in accordance with claim 10, further including kaolin and synthetic silica.

13. A carbonless record sheet coated with the coating composition of claim 5.

14. A color developer system in accordance with claim 2, further including an organic matrix comprising a copolymer of styrene and methacrylic acid containing no more than about 10% by weight methacrylic acid.

* * * * *